US006227480B1

(12) United States Patent
Huang

(10) Patent No.: US 6,227,480 B1
(45) Date of Patent: May 8, 2001

(54) DEVICE FOR DISPENSING AN ADHESIVE TAPE ROLL

(76) Inventor: Harrison Huang, No. 23, Lin T'So Rd., Shengkang, Taichung Hsein (TW)

( * ) Notice: Subject to any disclaimer, the term of this patent is extended or adjusted under 35 U.S.C. 154(b) by 0 days.

(21) Appl. No.: 09/412,357

(22) Filed: Oct. 5, 1999

(51) Int. Cl.[7] ..... B65H 75/02

(52) U.S. Cl. ..... 242/588.2

(58) Field of Search ..... 242/588, 588.1, 242/588.2, 405, 405.3, 613.5, 596, 596.7

(56) References Cited

U.S. PATENT DOCUMENTS 4,582,273 * 4/1986 Saraisky ..... 242/588.1
4,659,031 4/1987 Saraisky .
4,817,762 * 4/1989 Powell ..... 242/588.1
4,834,312 * 5/1989 Riemenschneider ..... 242/588.2
5,203,517 * 4/1993 Parry et al. ..... 242/588.2

* cited by examiner

*Primary Examiner*—John M. Jillions
(74) *Attorney, Agent, or Firm*—Browdy and Neimark

(57) ABSTRACT

An adhesive tape roll dispenser comprises a grip member and a revolving member. The grip member has a cylindrical body which is provided with a ring-shaped lip and a ring-shaped slot opposite to the ring-shaped lip and having a plurality of retaining hooks. The cylindrical body is further provided with a locating plate. The revolving member is provided with a ring-shaped stop plate, a ring-shaped insertion hook, and a pivoting plate. The revolving member is fitted over the cylindrical body of the grip member such that the pivoting plate is pivoted to the locating plate, and that the insertion hook of the revolving member is retained by the retaining hooks of the grip member. The revolving member and the grip member are coaxially engaged such that they revolve relative to each other and that they are incapable of an axial displacement in relation to each other. In light of the pivoting plate being pivoted to the locating plate, the revolving member and the grip member are pivoted with an appropriate tightness, thereby enabling the adhesive tape roll to be turned smoothly and stably time after time.

5 Claims, 6 Drawing Sheets

DEVICE FOR DISPENSING AN ADHESIVE TAPE ROLL

FIELD OF THE INVENTION

The present invention relates generally to an adhesive tape dispenser, and more particularly to a device designed to dispense a roll of adhesive tape.

BACKGROUND OF THE INVENTION

The U.S. Pat. Ser. No. 09/037,088 now U.S. Pat. No. 6,027,069, and Ser. No. 09/161,457 now U.S. Pat. No. 6,019,308, disclose a device for dispensing a roll of adhesive tape. These two devices are intended to overcome the deficiencies of a device which is disclosed in the U.S. Pat. No. 4,659,031 and is provided with a revolving member 41 of a tubular construction, and a grip member 42 having a tubular body 43, as shown in FIG. 1. The revolving member 41 is pivoted with the tubular body 43 of the grip member 42. If the revolving member 41 and the tubular body 43 are not pivoted with a proper tightness, the adhesive tape roll is prone to sway at the time when it is held with hand to facilitate the dispensing of the tape. In the event that the revolving member 41 and the tubular body 43 are pivoted with an excessive tightness, the revolving member 41 which is forced into a spool 44 tends to refrain the tubular body 43 of the grip member 42, thereby resulting in a sluggish rotation of the revolving member 41.

SUMMARY OF THE INVENTION

The primary objective of the present invention is to provide a device for dispensing an adhesive tape roll without causing the adhesive tape roll to sway.

The primary objective of the present invention is attained by a dispenser comprising a grip member and a revolving member, which are fitted together. The grip member has a cylindrical body which is provided with a ring-shaped lip and a ring-shaped slot opposite to the ring-shaped lip and having a plurality of retaining hooks. The cylindrical body is further provided with a locating plate. The revolving member is provided with a ring-shaped stop plate, a ring-shaped insertion hook, and a pivoting plate. The revolving member is fitted over the cylindrical body of the grip member such that the pivoting plate is pivoted to the locating plate, and that the insertion hook of the revolving member is retained by the retaining hooks of the grip member. The revolving member and the grip member are coaxially engaged such that they revolve relative to each other and that they are incapable of an axial displacement in relation to each other.

DETAILED DESCRIPTION OF THE INVENTION

Figure 1:
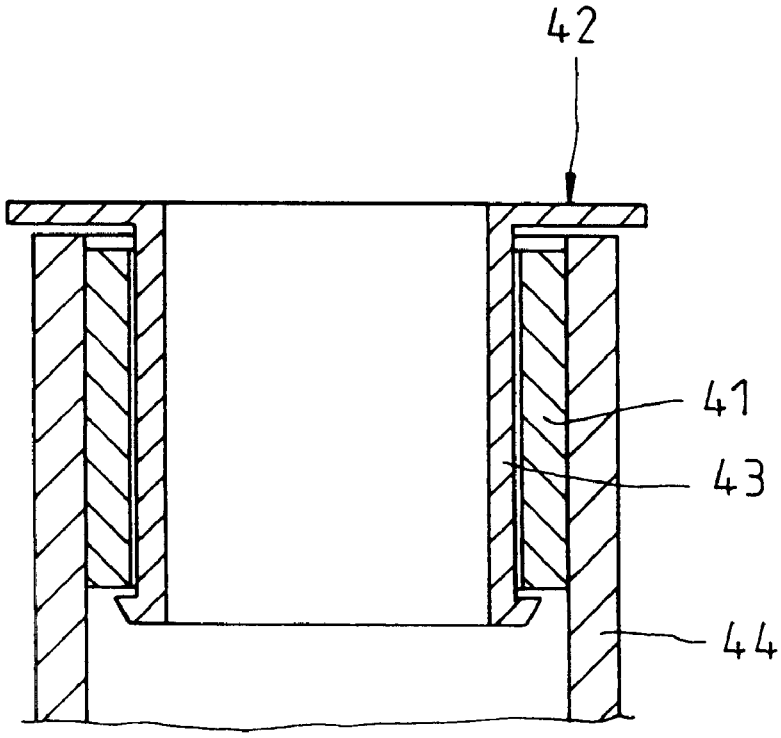
FIG. 1 PRIOR ART
FIG. 1 shows a schematic view of an adhesive tape roll dispenser of the prior art.
Figure 2:
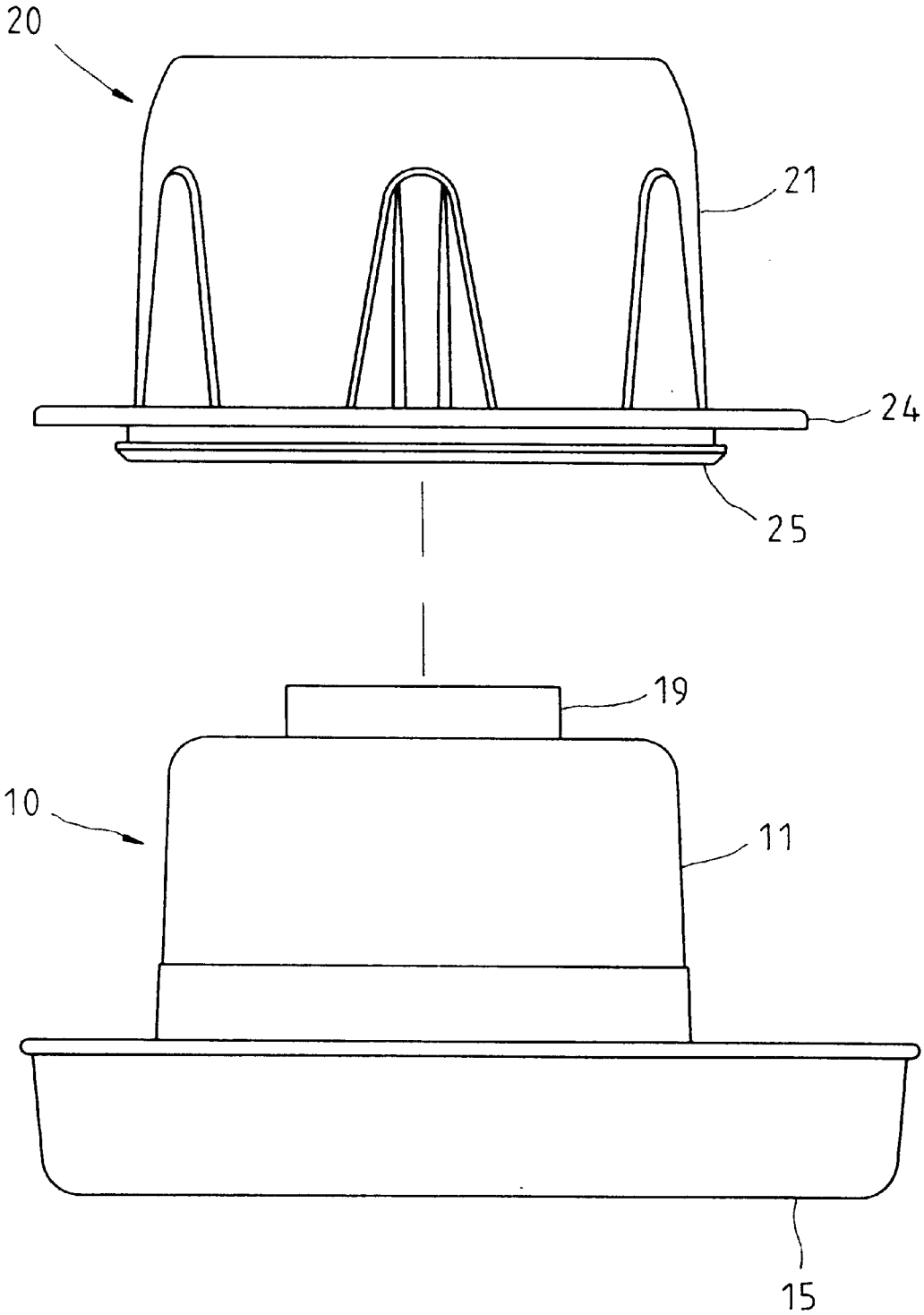
FIG. 2 shows an exploded view of a preferred embodiment of the present invention.
Figure 3:
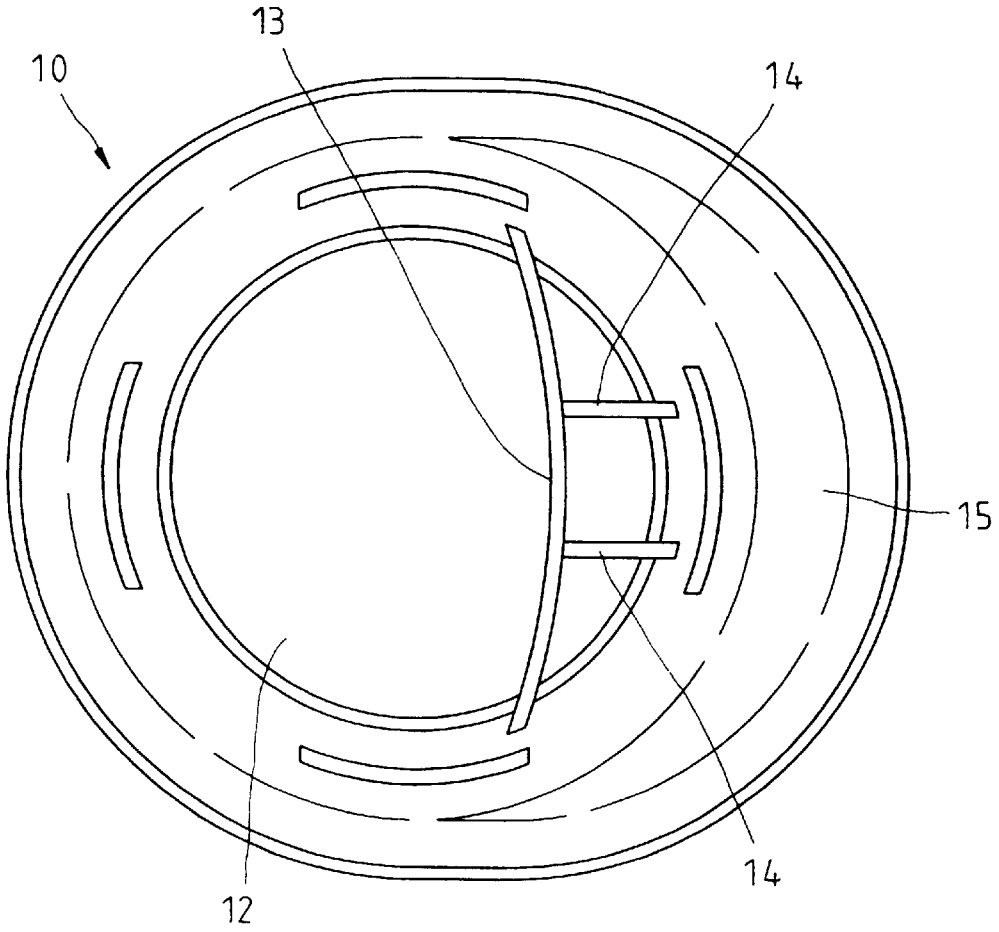
FIG. 3 shows a bottom plan view of the grip member of the preferred embodiment of the present invention.
Figure 4:
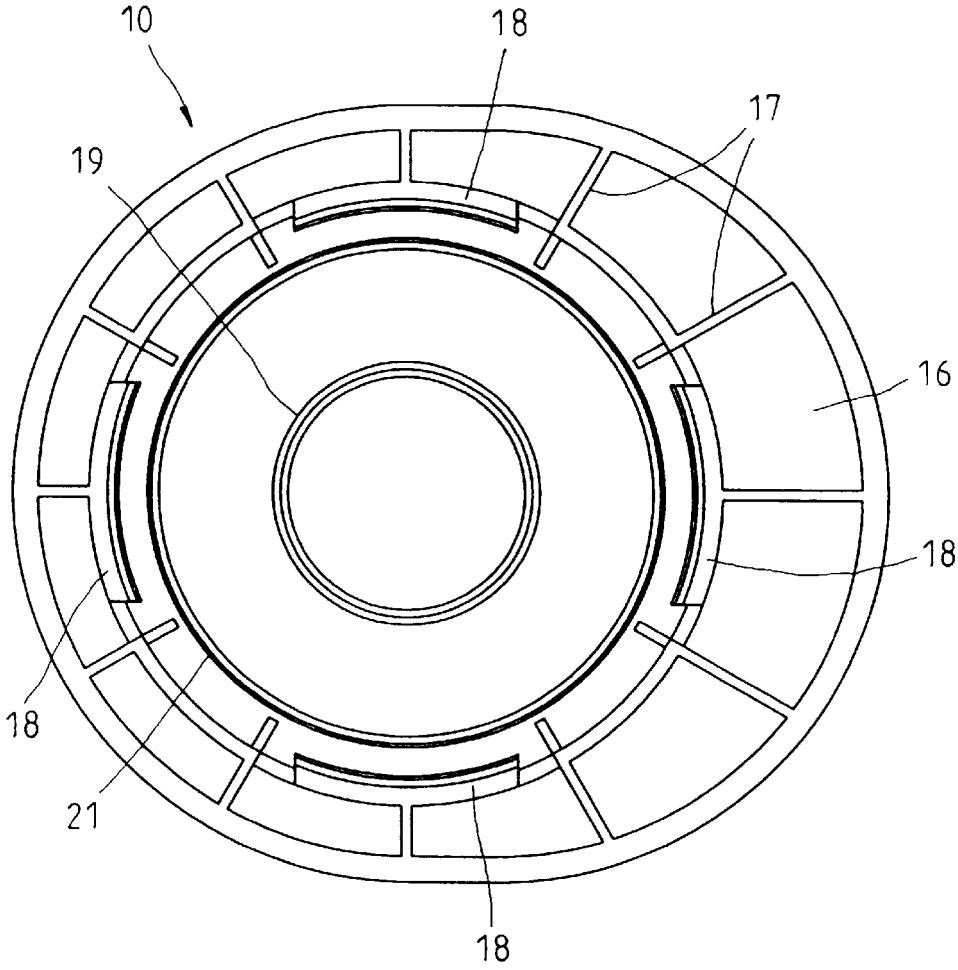
FIG. 4 shows a top plan view of the grip member of the preferred embodiment of the present invention.
Figure 5:
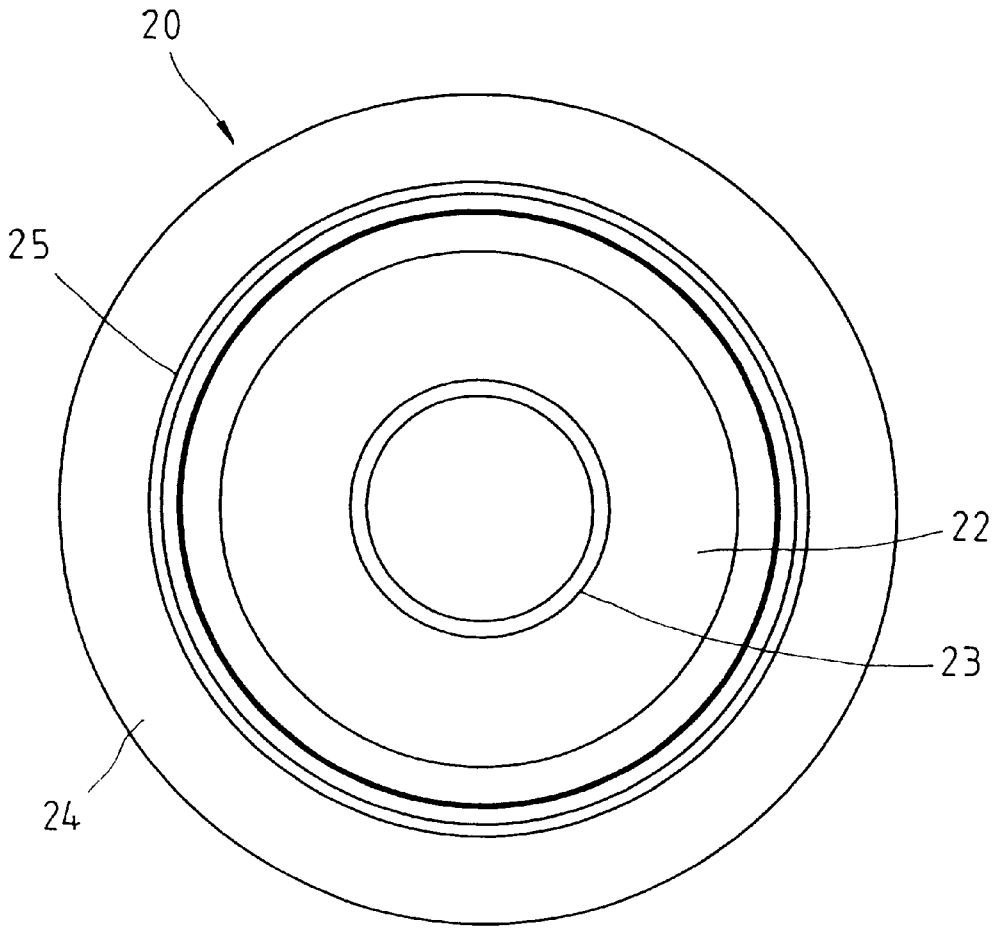
FIG. 5 shows a bottom plan view of the revolving member of the present invention.

As shown in all drawings provided herewith, an adhesive tape roll dispenser embodied in the present invention is formed of a grip member 10 and a revolving member 20.

The grip member 10 has a cylindrical body 11 which is provided with a cavity 12 for accommodating thumb and fingers. The cavity 12 is provided in one side thereof with an arcuate grip portion 13 to be held fast with fingers. Located between the walls of the arcuate grip portion 13 and the cavity 12 are two bracing plates 14. The cylindrical body 11 is provided at one end thereof with a ring-shaped lip 15, and a ring-shaped slot 16 opposite to the ring-shaped lip 15. The lip 15 has a portion which corresponds to one side of the arcuate grip portion 13 and is greater in the radial width than other portions thereof. This wider portion is intended to provide an easy grip of the grip member 10. The slot 16 is provided therein with a plurality of ribs 17 arranged in a radiate manner, and four retaining hooks 18 of an arcuate construction and having a center which is the axis of the cylindrical body 11. The retaining hooks 18 extend outward from the bottom of the slot 16 such that they are flush with the outer edges of the ribs 17 before bending inward. The outer side of the bending portion is provided with an inclined surface. The cylindrical body 11 is provided at the other end thereof with a locating ring 19 opposite to the ring-shaped lip 15.

The revolving member 20 has a cylindrical hollow body 21 of a tapered construction, with a closed end thereof being slightly smaller in diameter than an open end thereof. The closed end has an arcuate profile to facilitate the inserting of the cylindrical hollow body 21 into a spool of the adhesive tape. The cylindrical hollow body 21 is provided with a cavity 22 having a radial width greater than the outer diameter of the cylindrical body 11 of the grip member 10. The cavity 22 is provided in the underside thereof with a pivoting ring-shaped plate 23 coaxial with the cylindrical hollow body 21 and having an outer diameter equal to the inner diameter of the locating plate 19 of a ring-shaped construction. The cylindrical hollow body 21 is provided in the proximity of the open end thereof with a ring-shaped stop plate 24 extending outward from the outer wall thereof and is further provided at the brim of the open end thereof with a ring-shaped insertion hook 25 bending outward such that the outer side of the bending portion thereof is provided with an inclined surface.

Figure 6:
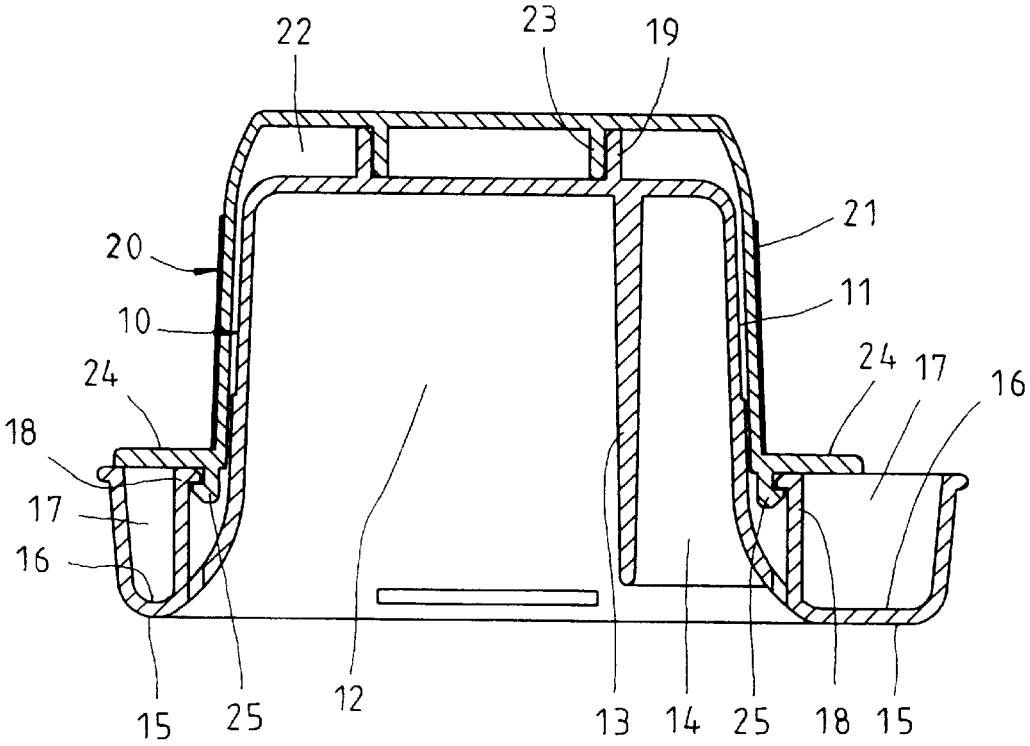
FIG. 6 shows a longitudinal sectional view of the preferred embodiment of the present invention in combination.

As shown in FIG. 6, the cylindrical hollow body 21 of the revolving member 20 is fitted over the cylindrical body 11 of the grip member 10 such that the pivoting plate 23 of the cylindrical hollow body 21 is retained by the locating plate 19 of the cylindrical body 11, and that the insertion hook 25 of the revolving member 20 is engaged with the retaining hooks 18 of the grip member 10, and further that the revolving member 20 and the grip member 10 turn in relation to each other, and further that the revolving member 20 and the grip member 10 are incapable of axial displacement in relation to each other.

The pivoting plate 23 and the locating plate 19 are pivotally joined together so as to keep the revolving member 20 and the grip member 10 in a coaxial fastening relationship. In the meantime, there is an interstice between the cylindrical hollow body 21 of the revolving member 20 and the cylindrical body 11 of the grip member 10. After being plugged into the spool of the adhesive tape roll, the compressed cylindrical hollow body 21 does not restrain the cylindrical body 11. In addition, the compression force of the spool is almost concentrated on the peripheral surface of the cylindrical hollow body 21. As a result, the pivoting plate 23 and the locating plate 19 are pivoted with precision, even if the end portion is exerted on by a small pressure which concentrates inward. In light of the pivoting plate 23 of the revolving member 20 being pivoted to the inner side of the locating plate 19 of the grip member 10, the chance that the pivoting plate 23 is pivoted to the locating plate 19 with excessive tightness is rather slim. For this reason, the dispenser of the present invention can not be jammed and compressed, so as to enable the revolving member 20 and the grip member 10 to remain in a pivotal association with an appropriate tightness. The adhesive tape roll can be thus turned smoothly and stably.

What is claimed is:

1. A device for dispensing an adhesive tape roll, said device comprising:

a grip member having a cylindrical body which is provided at one end surface thereof with a locating plate of a ring-shaped construction, said cylindrical body further provided at an open end thereof with a lip of a ring shape and extending outward from a brim of said open end, said cylindrical body further provided with a ring-shaped slot opposite to said lip whereby said slot is provided therein with a plurality of retaining hooks; and a revolving member having a cylindrical hollow body with a cavity, said cavity being provided in an underside thereof with a pivoting plate of a ring-shaped construction, said cylindrical hollow body being provided at an open end thereof with a ring-shaped stop plate extending outward and radially from a brim of said open end thereof, and an insertion hook of a ring-shaped construction;

said cylindrical hollow body of said revolving member being fitted over said cylindrical body of said grip member such that said pivoting plate is pivoted with said locating plate, and that said insertion hook is engaged with said retaining hooks.

2. The device as defined in claim 1, wherein said pivoting plate of said revolving member is pivoted to an inner side of said grip member.

3. The device as defined in claim 1, wherein said cylindrical body of said grip member is provided with a cavity which is provided in one side thereof with a grip portion, and a plurality of bracing plates located between walls of said grip portion and said cavity; and wherein said lip has a portion which is corresponding to one side of said grip portion and is greater in a radial width than other portions thereof.

4. The device as defined in claim 1, wherein said retaining hooks of said grip member are four in number and are arranged equiangularly and symmetrically, with each of said retaining hooks being arcuate in shape and bending outward in such a manner that an outer side of a bending portion thereof is provided with an inclined surface.

5. The device as defined in claim 1, wherein said ring-shaped slot of said grip member is provided therein with a plurality of ribs whereby said ribs are arranged in a radiate manner such that outer edges of said ribs are flush with one another, and that said outer edges of said ribs are pressed against by said ring-shaped stop plate of said revolving member.

* * * * *